US007000985B2

(12) United States Patent
Belgarde

(10) Patent No.: US 7,000,985 B2
(45) Date of Patent: Feb. 21, 2006

(54) ADJUSTABLE NON-FREESTANDING CHILD SEAT

(76) Inventor: Douglas Jay Belgarde, 3023 SE. 59th Ave., Portland, OR (US) 97206

( * ) Notice: Subject to any disclaimer, the term of this patent is extended or adjusted under 35 U.S.C. 154(b) by 0 days.

(21) Appl. No.: 10/936,444

(22) Filed: Sep. 7, 2004

(65) Prior Publication Data

US 2005/0116518 A1 Jun. 2, 2005

Related U.S. Application Data

(60) Provisional application No. 60/500,439, filed on Sep. 4, 2003.

(51) Int. Cl.
*A47C 1/08* (2006.01)

(52) U.S. Cl. ..... 297/255; 297/230.1; 297/230.11; 297/230.14; 297/250.1; 297/254; 297/256.11; 297/485

(58) Field of Classification Search ..... 297/230.1, 297/230.11, 230.14, 250.1, 254 X, 255, 256.1, 297/256.11, 256.13, 485
See application file for complete search history.

(56) References Cited

U.S. PATENT DOCUMENTS

| | | | | |
|---|---|---|---|---|
| 1,641,953 | A | 9/1927 | Abraham | |
| 1,742,822 | A | 1/1930 | Olson | |
| 2,359,599 | A * | 10/1944 | Allen | 297/182 |
| 4,871,210 | A * | 10/1989 | Alexander et al. | 297/485 |
| 5,499,860 | A * | 3/1996 | Smith et al. | 297/255 |
| 6,688,701 | B1 * | 2/2004 | Weaver | 297/485 |
| 6,692,072 | B1 * | 2/2004 | Nelson et al. | 297/250.1 |
| 6,767,058 | B1 * | 7/2004 | McClellan-Derrickson | 297/255 |

* cited by examiner

*Primary Examiner*—Laurie K. Cranmer
(74) *Attorney, Agent, or Firm*—Steven J. Adamson

(57) ABSTRACT

A non-freestanding child seat for use with in underlying seat or other support structure. The child seat is well-suited for use with "spectator" seats such as those found at sport event, theatres, and performing arts venues. The child seat may including a flexible member that is placed over and/or attached to an underlying seat or other structure. A child seat platform is attached to the flexible member and configured for position adjustment among other features.

18 Claims, 4 Drawing Sheets

ADJUSTABLE NON-FREESTANDING CHILD SEAT

CROSS REFERENCE TO RELATED APPLICATIONS

This application claims the benefit of U.S. Provisional Application No. 60/500,439, filed Sep. 4, 2003, and having the same title and inventor(s) as above.

FIELD OF THE INVENTION

The present invention relates to non-freestanding child seats. Child seats in accordance with the present invention are particularly well suited for use on "spectator" of "stadium" seating, e.g., the type of seating found at sporting events, theatres and/or other events, performances or venues, though the seat may be used with any suitable support structure.

BACKGROUND OF THE INVENTION

Various child seats are known in the art, including child seats that are free-standing and child seats that are not non-freestanding child seats, i.e., made for attachment to a support structure of some type. Prior art child seats include those that offer protection from injury, such as vehicle safety seats, and those that permit a child to be seated at a desired height, such as table height for feeding and participating in family meals.

Representative prior art child seats include those disclosed in U.S. Pat. No. 1,641,953 issued to Abraham for a Convertible Baby Seat; U.S. Pat. No. 1,742,822 issued to Olson for an Auxiliary Seat for Automobiles; and U.S. Pat. No. 5,499,860 issued to Smith for a Collapsible Child Seat.

While providing some beneficial aspects, prior art child seats (particularly non-freestanding seats) are disadvantageous for many reasons, including, but not limited to, the following: limited or no adjustability of seat height or position; limited or constrained seat attachment mechanisms which defeat more universal application; and the absence of a mechanism for keeping the chair (or other structure) to which the child seat is attached free of dirt and debris, such as dirt from the child's shoes or foodstuff dropped by the child. This latter problem is a major concern at stadiums, theatres and other public venues.

The present invention overcomes these disadvantages aspects and provides additional benefits.

SUMMARY OF THE INVENTION

Accordingly, it is an object of the present invention to provide a child seat that is suitable for use with spectator seating and other support structures.

It is another object of the present invention to provide a child seat that is readily adjustable and/or configured for more universal use, relative to prior art seats.

It is also an object of the present invention to provide such a child seat that is lightweight, portable and/or capable of manufacture in a cost-efficient manner.

These and related objects of the present invention are achieved by use of an adjustable non-freestanding child seat as described herein.

In one aspect, a non-freestanding child seat apparatus of the present invention may include a cover member made of a flexible material and having a back portion configured to cover at least part of the back of a sitting structure and a seat portion configured to cover the seat of the sitting structure. The child seat may also include a seat platform adjustably coupled to said back portion, and an attachment mechanism for releasably coupling the back portion to a sitting structure.

In another aspect, a non-freestanding child seat apparatus of the present invention may include a member made of flexible material that is configured for releasable attachment to a sitting structure and to fit over and descend from at least a portion of a sitting structure. The child seat may also include a seat platform coupled to the flexible member in a manner that permits adjustment of the height of the seat platform, and an attachment mechanism for releasably coupling the flexible member to a sitting structure.

In yet another aspect, a non-freestanding child seat apparatus of the present invention may include a member made of flexible material that is configured for releasable attachment to a sitting structure and to fit over and descend from at least a portion of a sitting structure. The child seat may also include a seat platform coupled to the flexible member, and an attachment mechanism that releasably couples the flexible member to a sitting structure, the attachment member including a first type of fastening member that functions based on gravity and a second type of fastening member that functions based on mated-coupling.

The attainment of the foregoing and related advantages and features of the invention should be more readily apparent to those skilled in the art, after review of the following more detailed description of the invention taken together with the drawings.

DETAILED DESCRIPTION

Figure 2:
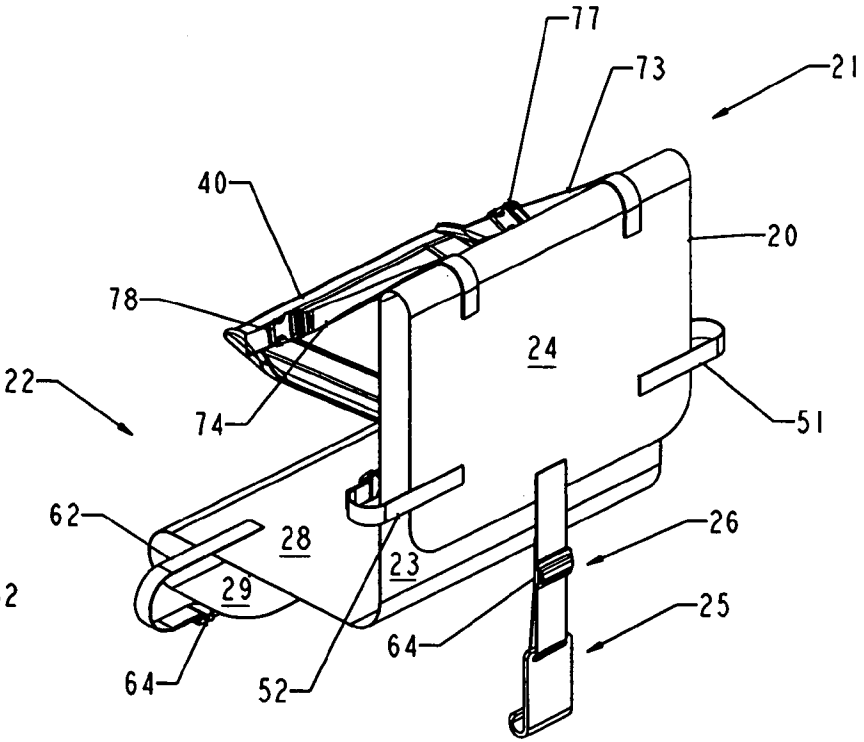
FIGS. 1–2 are perspective views of a non-freestanding child seat in accordance with the present invention.
Figure 1:
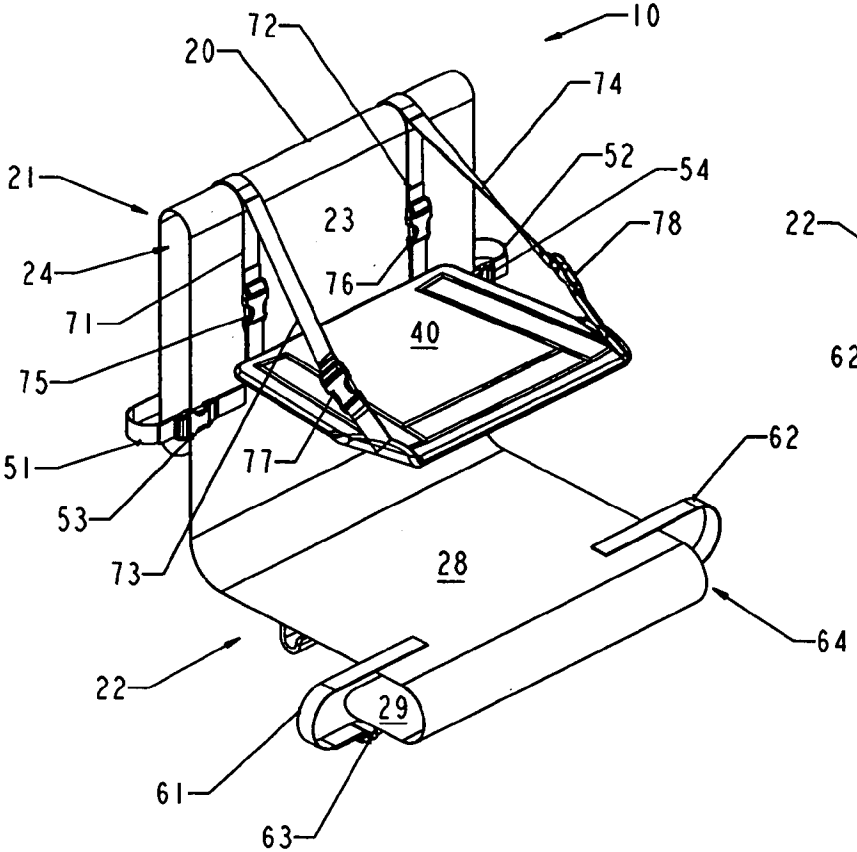

Referring to FIGS. 1–2, a front perspective view and a back perspective view of an adjustable, non-freestanding child seat 10 in accordance with the present invention are shown. Seat 10 is shown as it might appear in use (when fitted over a chair or other structure, though that chair or other structure is not shown).

Seat 10 includes a support and shield member 20 ("support member 20"), a seat 40, and a plurality of straps and buckles. Support member 20 may be a continuous member that includes a first section 21 which fits over the back of a chair and a second section 22 which fits over the seat of a chair. Note that the term chair is used here to avoid confusion with the word seat. As used in the present discussion, the word seat is generally intended to mean the part of a sitting structure that a person typically sits on. Chair is intended to mean any sitting structure, such as a theatre seat, etc., whether it is coupled to or separate from other sitting structures.

First section 21 includes front and back flaps 23–24 that respectively cover the front and back sides of a chair back. An anchor member 25 (FIG. 2) securely attaches first section 21 (and support member 20) to the back or base of a chair. Straps 51,52 are coupled to back flap 24 and respectively terminate at releasable buckles 53–54 which are coupled to front flap 23. This arrangements permits the coupling of the front and back flaps over a chair back. The buckles 53–54 are preferably adjustable permitting a user to cinch the flaps together tightly and hold flap 23 proximate a chair back.

Second section 22 includes a top and bottom flap 28–29, respectively, that cover or "shield" the seat of a chair. Straps 61,62 are coupled to top flap 28 and respectively terminate at releasable buckles 63–64 which are coupled to bottom flap 29. This arrangements permits the coupling of the front and back flaps over a chair seat. Furthermore, straps 61,62 may be provided in a location where they attach behind a chair leg or a bend in the chair seat, thereby anchoring section 22 in position over the chair seat.

Seat 40 is preferably made of a flexible material with added reinforcement, though it may be made in other configurations (e.g., the seat may be substantially inflexible, a planar sheet preferably covered with padding, or the like). In the embodiment of FIG. 1, seat 40 is mounted to support structure 20 by four straps 71–74 and corresponding buckles 75–78. The buckles may be adjustable to permit adjustment of the front and/or back of seat 40 to establish a desired tilt (seat position) and a desired seat height.

FIG. 2 illustrates anchor member 25 and adjustable buckle 64, among other components discussed with reference to FIG. 1 and labeled with their appropriate reference number.

Figure 3:
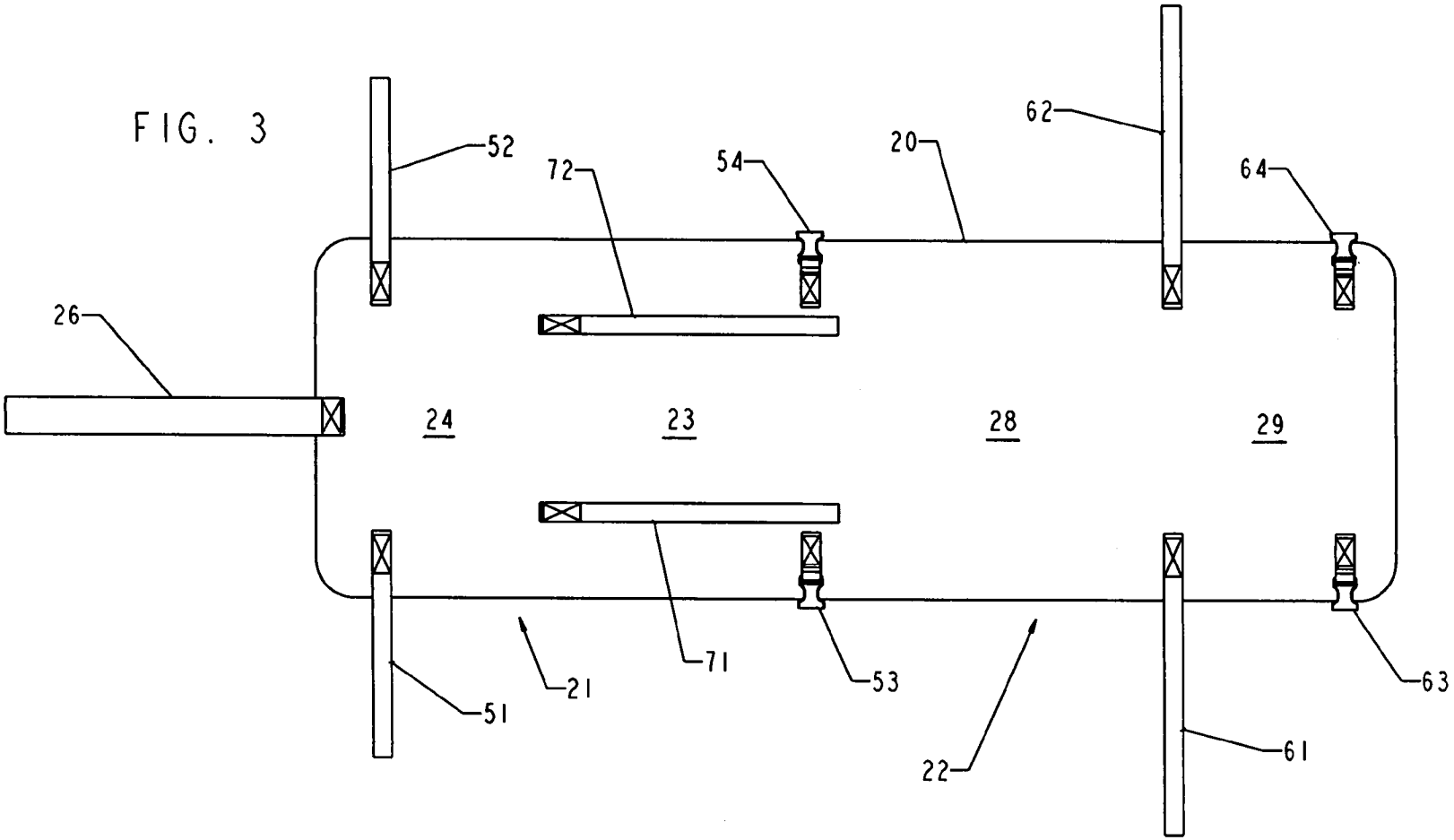
FIG. 3 is a plan view of part of the child seat of FIG. 1.

Referring to FIG. 3, a plan view of child seat 10 of FIGS. 1–2 without seat 40 and in an unfolded position is shown. Support member 20 is preferable a flexible, foldable material that when laid flat may have a configuration as shown in FIG. 3, though other configurations are possible without deviating from the present invention. First and second sections 21,22 include their respective flaps 23–24 and 28–29. The arrangement of straps 51,52,61,62,71–74 and buckles 53,54,63,64 may be as shown.

Support member 20 may be made of nylon material, such as 300–400 denier nylon, or another suitable material. The straps may be made of commercially available nylon or other suitable material. Suitable buckles 53,54,63,64 are known and available commercially. The straps and buckle attachment members may be sown to support member 20 via industry known sewing techniques or joined in another suitable manner or fabricated as an integral part of the support member, etc. The dashed lines in straps 71,72 indicate where each strap is bent back to hold its respective seat attachment buckle.

Figure 4:
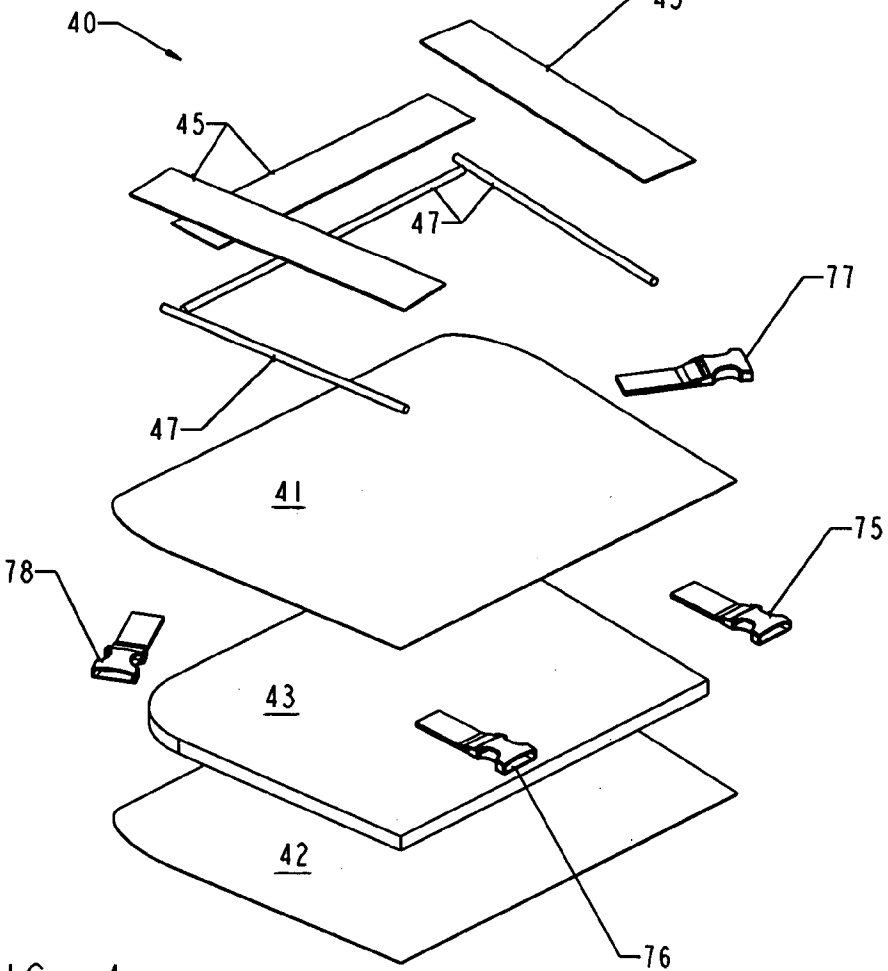
FIGS. 4–6 illustrates components of the child seat of FIG. 1.
Figure 5:
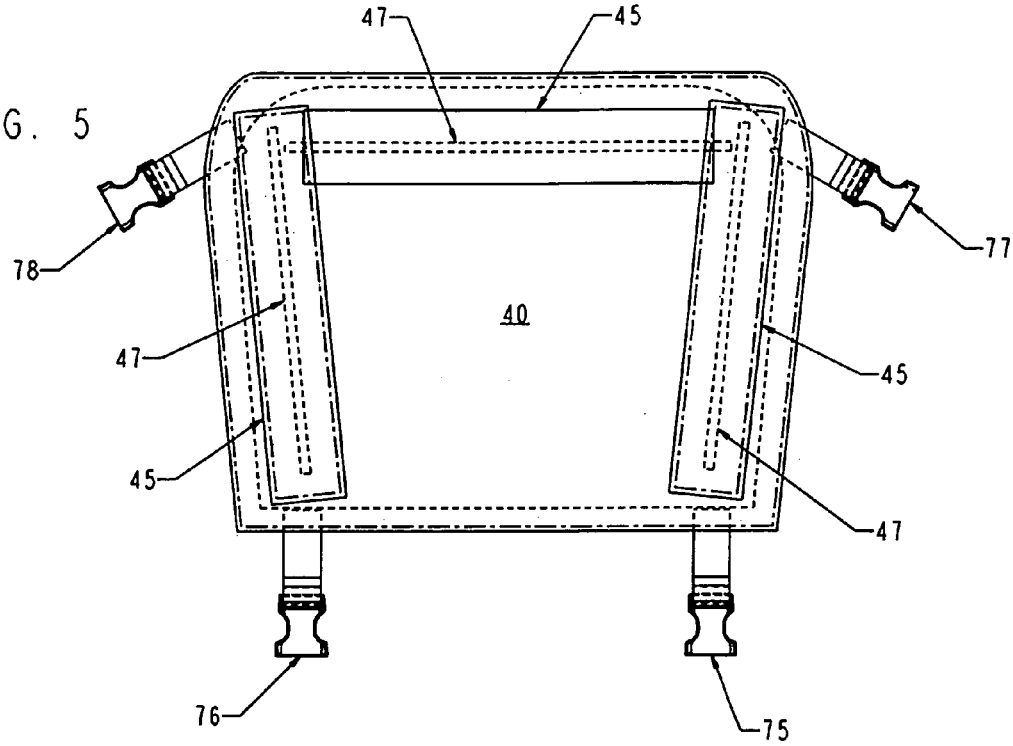

Referring to FIGS. 4–5, an exploded view and an assembled plan view of seat 40 in accordance with the present invention is shown. Seat 40, in one embodiment, may include a top and a bottom member 41,42 that cover cushioning material 43. Buckles 75–78 are coupled to seat 40 and may be attached to the seat in the same sewing operation that joins top and bottom members 41,42 around cushioning material 43. Attachment members or straps 85–88 are shown coupled to one portion of each buckle 75–78.

Structural reinforcement members may also be provided to enhance the structural integrity of the seat, particularly when in use. In one embodiment, a plurality of rods 47, fiberglass or other, are provided in sheaths or pockets 45 formed by the attachment of strips of appropriate material (such as nylon or other suitable material) to seat 40. The pockets 45 may be formed in a non-sealed or releasably sealed manner such that the support members 47 may be removed for more compact storage or laundering, etc.

FIG. 5 illustrates the seat of FIG. 4 with the various components provided in their appropriate position and secured in those positions. Component securing may be achieved by sewing, glue, heat sealing, a combination of these techniques and/or by any other suitable securing means. Velcro®, buttons, zippers or other release fasteners may be used for releasable openings.

The appropriate straps and bracket halves are then added to seat 40 and it may then be attached to support member 20 of FIG. 3 (i.e., clipped into) to achieve the child seat 10 of FIGS. 1–2.

Figure 6:
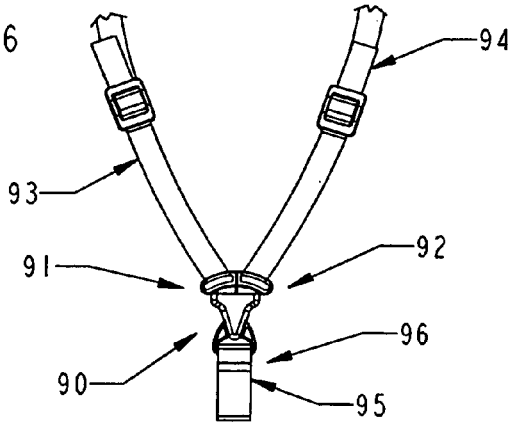

Referring to FIG. 6, one of many seat belt arrangements in accordance with the present invention is shown. Seat belt assembly 90 may be much like a child safety harness used in a child car seat. In one embodiment, it includes a buckle unit 90 having two adjustable buckles 91,92 for respective coupling of over the shoulder safely straps 93,94. These straps 93,94 may couple to support member 20. The other part of unit 90 may be coupled through straps 95 to the underside of seat 40 or another suitable location. An adjustable and/or releasable buckle 96 may be provided in this strap.

In closing, it should be recognized that the child seat 10 described herein may include a fully-adjustable seat 40 having a plurality of adjustable attachment straps, and be configured for securing to a wide variety of chairs or other structures. The child seat may also include a section that protects the underlying chair, seat or other structure to which child seat 10 is mounted. Made of a flexible material, child seat 10 may be easily folded into a relatively small, inconspicuous volume, and may be readily laundered.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A non-freestanding child seat apparatus, comprising:

a cover member made of a flexible material and longer than wide having a back portion configured to cover at least in part the back of a sitting structure and a seat portion configured to cover the seat of a sitting structure;

a seat platform adjustably coupled to said back portion; and an attachment mechanism for releasably coupling said back portion to a sitting structure;

wherein said back portion has provided proximate a top portion thereof a plurality of adjustable seat platform attachment members.

2. The apparatus of claim 1, wherein said cover member is formed substantially of a flexible sheet material.

3. The apparatus of claim 1, wherein said seat platform is coupled to said cover member in a manner that permits adjustment of the height of said seat platform.

4. The apparatus of claim 1, wherein said seat platform is coupled to said cover member in a manner that permits adjustment of the tilt of said seat platform.

5. The apparatus of claim 1, wherein said attachment mechanism includes a plurality of fastening mechanisms for releasably securing said cover member to a sitting structure.

6. The apparatus of claim 5, wherein said plurality of fastening mechanisms includes at least a first type of fastening member that functions based on gravity and a second type of fastening member that functions based on mated-coupling.

7. The apparatus of claim 1, further comprising a child retaining mechanism that retains a child safely in said child seat apparatus.

8. A non-freestanding child seat apparatus, comprising:

a cover member made of flexible material that is configured for releasable attachment to a sitting structure and to fit over and descend from at least a portion of a sitting structure;

a seat platform coupled to said flexible cover member in a manner that permits adjustment of the height of said seat platform; and an attachment mechanism for releasably coupling said flexible member to a sitting structure;

wherein said flexible cover member has provided proximate a top portion thereof a plurality of seat platform attachment members, said seat platform being coupled to said flexible cover member through said plurality of seat platform attachment members in a manner that permits adjustment of the position of said seat platform relative to the flexible cover member.

9. The apparatus of claim 8, wherein said seat platform is coupled to said flexible cover member in a manner that permits adjustment of the tilt of said seat platform.

10. The apparatus of claim 8, wherein said flexible cover member is configured to be longer than wide and to substantially cover a back portion and a seat portion of a sitting structure to which said apparatus is releasably attached.

11. The apparatus of claim 8, wherein said attachment mechanism includes a plurality of fastening mechanisms for releasably attaching said flexible cover member to a sitting structure.

12. The apparatus of claim 11, wherein said plurality of fastening mechanisms includes at least a first type of fastening member that functions based on gravity and a second type of fastening member that functions based on mated-coupling.

13. The apparatus of claim 8, further comprising a child retaining mechanism that retains a child safely in said child seat apparatus.

14. A non-freestanding child seat apparatus, comprising:

a member made of flexible material that is configured for releasable attachment to a sitting structure and to fit over and descend from at least a portion of a sitting structure;

a seat platform coupled to said flexible member; and an attachment mechanism that releasably couples said flexible member to a sitting structure, said attachment member including a first type of fastening member that functions based on gravity and a second type of fastening member that functions based on mated-coupling;

wherein said flexible member includes a back portion configured to cover at least in part the back of a sitting structure and said apparatus further comprises a plurality of adjustable seat platform attachment members provided proximate said back portion.

15. The apparatus of claim 14, wherein said flexible member is configured to be longer than wide and to substantially cover a back portion and a seat portion of a sitting structure to which said apparatus is releasably attached.

16. The apparatus of claim 14, wherein said seat platform is coupled to said flexible member in a manner that permits adjustment of the height of said seat platform.

17. The apparatus of claim 14, wherein said seat platform is coupled to said flexible member in a manner that permits adjustment off the tilt of said seat platform.

18. The apparatus of claim 14, further comprising a child retaining mechanism that retains a child safely in said child seat apparatus.

* * * * *